US012378088B2

(12) United States Patent
Ishii

(10) Patent No.: US 12,378,088 B2
(45) Date of Patent: Aug. 5, 2025

(54) SHEET FEEDER CAPABLE OF ACCOMMODATING AND FEEDING SHEETS

(71) Applicant: KYOCERA Document Solutions Inc., Osaka (JP)

(72) Inventor: Akira Ishii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 157 days.

(21) Appl. No.: 18/213,849

(22) Filed: Jun. 25, 2023

(65) Prior Publication Data

US 2024/0010452 A1 Jan. 11, 2024

(30) Foreign Application Priority Data

Jul. 5, 2022 (JP) ..... 2022-108370

(51) Int. Cl.
*B65H 3/06* (2006.01)
*B65H 3/56* (2006.01)

(52) U.S. Cl.
CPC ..... *B65H 3/0684* (2013.01); *B65H 3/56* (2013.01); *B65H 2801/06* (2013.01)

(58) Field of Classification Search
CPC ..... B65H 3/0684; B65H 1/266
See application file for complete search history.

(56) References Cited

U.S. PATENT DOCUMENTS 5,501,444 A * 3/1996 Yukimachi ..... B65H 3/0684 271/9.13
6,217,018 B1 * 4/2001 Tay ..... B65H 3/0684 271/145
6,659,449 B2 * 12/2003 Kim ..... B65H 3/0684 271/164
2016/0046456 A1 * 2/2016 Woo ..... B65H 3/0684 271/147

FOREIGN PATENT DOCUMENTS

JP 2006076692 A 3/2006

* cited by examiner

*Primary Examiner* — Howard J Sanders
(74) *Attorney, Agent, or Firm* — IP Business Solutions, LLC.

(57) ABSTRACT

A sheet feeder includes: a sheet feed roller holding member that holds a pick-up roller capable of coming into contact with and away from a top surface of a sheet, supports the pick-up roller rotatably, and pivotally moves while urging the pick-up roller toward contact with the top surface of the sheet; a restricting member that restricts pivotal movement of the sheet feed roller holding member, resulting in restriction of movement of the pick-up roller toward the contact with the top surface of the sheet; and a restriction cancelling portion that is provided in a sheet feed cassette and abuts against the restricting member to apply to the restricting member a pressing force from the sheet feed cassette, thus cancelling the restriction of the restricting member.

4 Claims, 14 Drawing Sheets

SHEET FEEDER CAPABLE OF ACCOMMODATING AND FEEDING SHEETS

INCORPORATION BY REFERENCE

This application claims priority to Japanese Patent Application No. 2022-108370 filed on Jul. 5, 2022, the entire contents of which are incorporated by reference herein.

BACKGROUND

The present disclosure relates to sheet feeders capable of accommodating and feeding sheets.

A known sheet feeder mounted in a copier, a multifunction peripheral or so on includes: a sheet feed cassette accommodating a stack of sheets; a pick-up roller that feeds out a sheet from the stack accommodated in the sheet feed cassette; a feed roller that conveys the sheet fed out by the pick-up roller; and a retard roller that forms, together with the feed roller, a nip where the sheet is pinched between them and conveys the sheet while separating it from the other sheets.

There is also known a pick-up roller that, in operative association with the operation of loading of a sheet feed cassette into a sheet feeder, moves toward contact with the top surface of the uppermost of a stack of sheets accommodated in the sheet feed cassette and then moves to a position to be finally reached which is a predetermined pick-up position (the level of the top surface of the uppermost sheet when the sheet feed cassette has reached its maximum capacity to accommodate sheets).

SUMMARY

A technique improved over the aforementioned techniques is proposed as one aspect of the present disclosure.

A sheet feeder according to an aspect of the present disclosure includes a sheet feed cassette, a pick-up roller, a pick-up holding member, a first restricting member, a second restricting member, a first restriction cancelling portion, and a second restriction cancelling portion. The sheet feed cassette is capable of being loaded into and unloaded from a device body of the sheet feeder, capable of being withdrawn from a back toward a front of the device body, and capable of accommodating a plurality of sheets. The pick-up roller is provided in the device body and is capable of moving toward a top surface of the uppermost of the plurality of sheets accommodated in the sheet feed cassette and rotating in contact with the top surface of the uppermost sheet to thus feed the uppermost sheet out of the sheet feed cassette. The pick-up holding member is provided in the device body, holds the pick-up roller capable of coming into contact with and away from the top surface of the uppermost sheet, supports the pick-up roller rotatably, and supports the pick-up roller while urging the pick-up roller toward contact with the top surface of the uppermost sheet. Furthermore, when operatively associated with operation of loading of the sheet feed cassette into the device body, the pick-up holding member makes pivotal movement to move the pick-up roller toward contact with the top surface of the uppermost sheet and move the pick-up roller to a predetermined position to be finally reached. The first restricting member is provided in the device body and restricts the pivotal movement of the pick-up holding member, resulting in restriction on movement of the pick-up roller toward contact with the top surface of the uppermost sheet. The second restricting member is disposed rearward of the first restricting member in the device body and restricts the pivotal movement of the pick-up holding member, resulting in restriction on movement of the pick-up roller toward contact with the top surface of the uppermost sheet. The first restriction cancelling portion is provided in the sheet feed cassette and abuts against the first restricting member in the device body to apply a pressing force from the sheet feed cassette to the first restricting member, thus cancelling the restriction of the first restricting member. The second restriction cancelling portion is provided in the sheet feed cassette and, in association with cancellation of the restriction of the first restricting member by the first restriction cancelling portion in the device body, abuts against the second restricting member to apply a pressing force from the sheet feed cassette to the second restricting member, thus cancelling the restriction of the second restricting member upon completion of loading of the sheet feed cassette.

DETAILED DESCRIPTION

Figure 1:
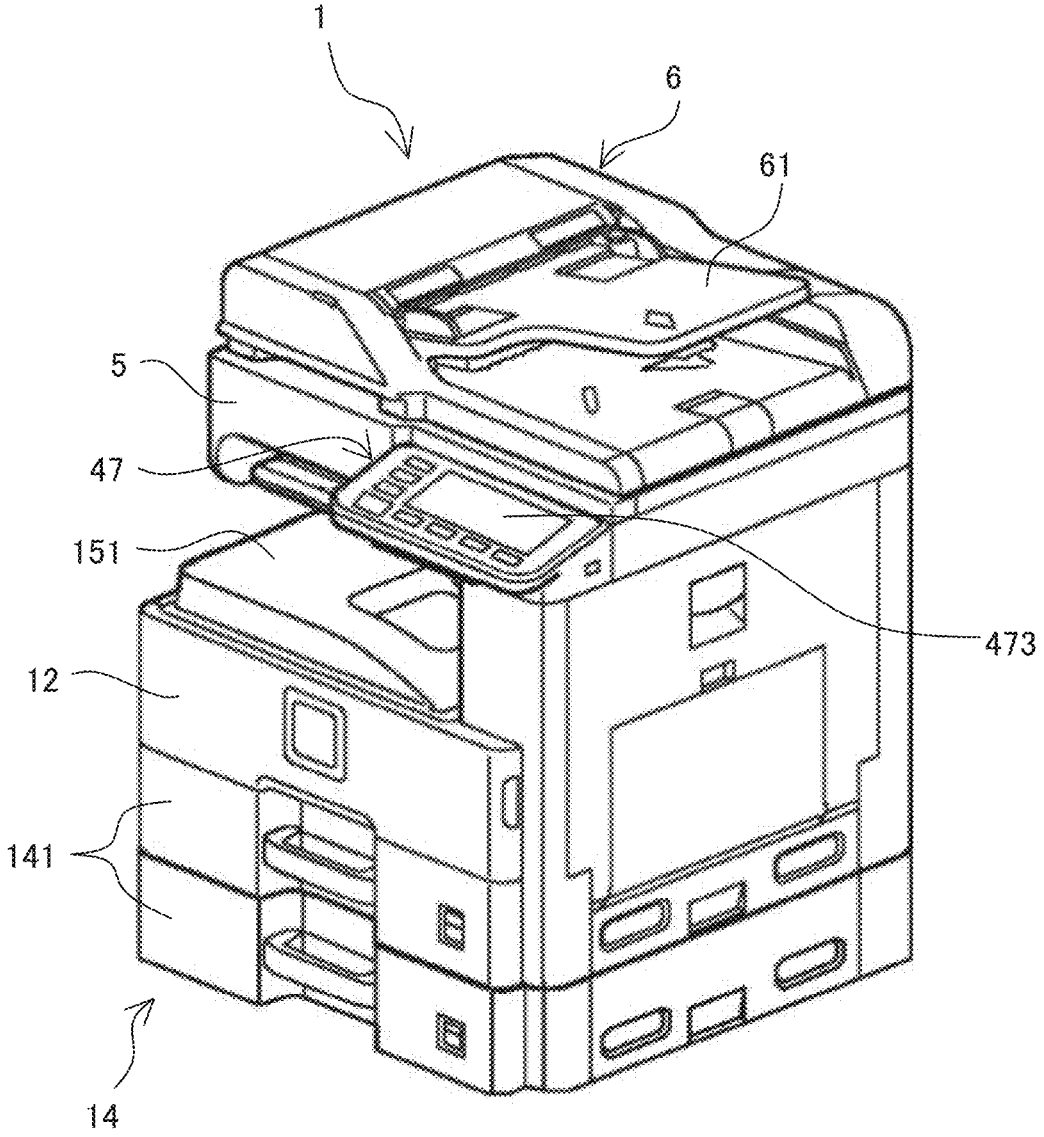
FIG. 1 is a perspective view showing the appearance of an image forming apparatus equipped with a sheet feeder according to an embodiment of the present disclosure.

Hereinafter, a description will be given of a sheet feeder according to an embodiment of the present disclosure with reference to the drawings. FIG. 1 is a perspective view showing the appearance of an image forming apparatus equipped with the sheet feeder according to the embodiment of the present disclosure.

The image forming apparatus 1 is, for example, a multi-function peripheral having multiple functions, such as a copy function, a print function, a scan function, and a facsimile function and includes a document feed device 6, a document reading device 5, an image forming device 12, a sheet feeder 14, and an operation device 47.

The document feed device 6 is mounted on the top surface of the document reading device 5 by unshown hinges or the like and is thus openable and closable with respect to the document reading device 5. The document feed device 6 functions as a document holding cover when the document reading device 5 reads an original document placed on an unshown platen glass. Furthermore, the document feed device 6 is an automatic document feed device called an ADF (auto document feeder), includes a document loading tray 61, and feeds, on a sheet-by-sheet basis, original documents loaded onto the document loading tray 61 to the document reading device 5.

First, a description will be given of the case where a document reading operation is performed on the image forming apparatus 1. The document reading device 5 optically reads an image of an original document fed to the document reading device 5 by the document feed device 6 or an image of an original document placed on the platen glass and generates image data on the document. The image data generated by the document reading device 5 is saved in an unshown image memory or the like.

Next, a description will be given of the case where an image forming operation is performed on the image forming apparatus 1. Based on image data generated by the document reading operation, image data received from a computer as an external device (for example, a personal computer) connected via a network or another image data, the image forming device 12 forms a toner image on a sheet as a recording medium fed from the sheet feeder 14.

The sheet with the toner image formed thereon by the image forming device 12 is subjected to fixation processing and then discharged to a sheet output tray 151. The sheet feeder 14 includes a plurality of sheet feed cassettes 141.

The operation device 47 accepts operator's instructions for various types of operations and processing executable by the image forming apparatus 1, such as an instruction to execute an image forming operation. The operation device 47 includes a display device 473 that displays operation guidance and other types of information for the operator.

Figure 2:
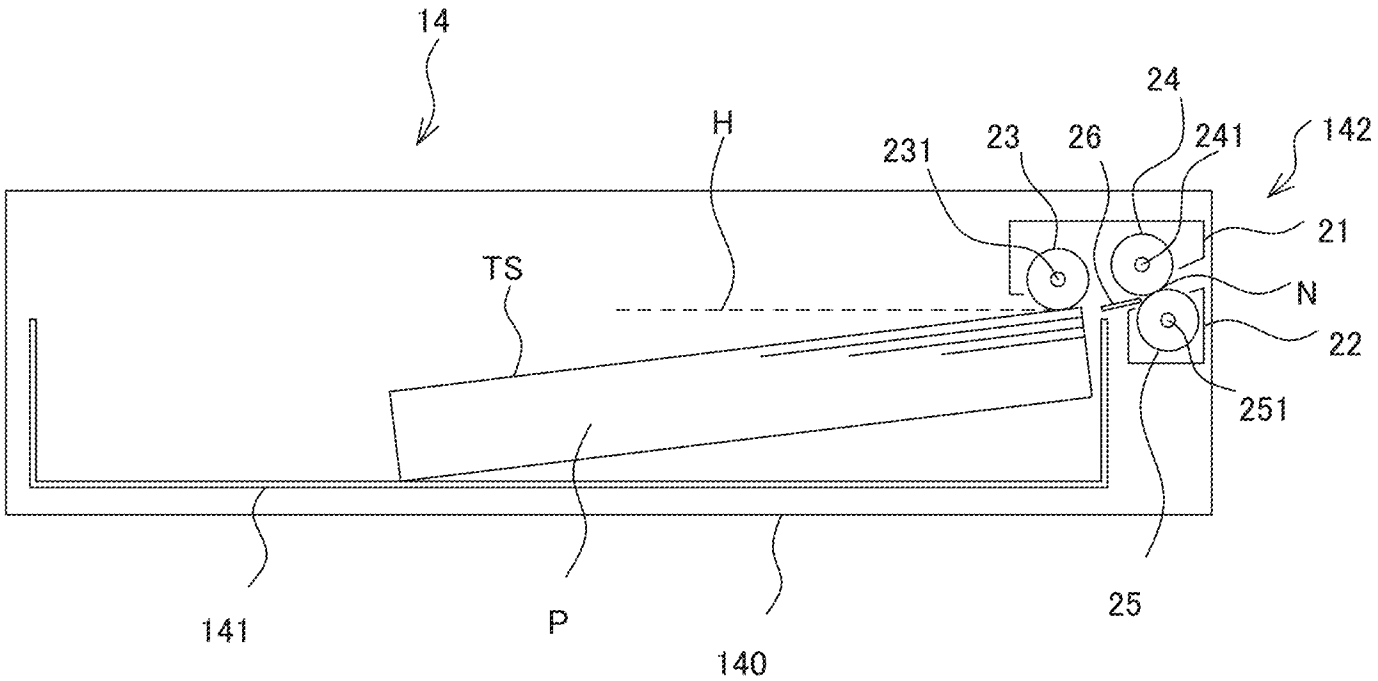
FIG. 2 is a frontal cross-sectional view schematically showing the sheet feeder.

FIG. 2 is a frontal cross-sectional view schematically showing the sheet feeder 14. The sheet feeder 14 includes: the plurality of sheet feed cassettes 141 capable of being loaded into and unloaded from a device body 140 of the sheet feeder 14, capable of being withdrawn from the back toward the front of the device body 140; and capable of accommodating a plurality of sheets P; and a plurality of sheet feed units 142, one for each of the plurality of sheet feed cassettes.

The sheet feed units 142 are provided in the device body 140. Each of the sheet feed units 142 includes: an upper guide unit 21 forming the top surface of a conveyance path for the sheet P; a lower guide unit 22 forming the bottom surface of the conveyance path for the sheet P; a pick-up roller 23, a feed roller 24, a retard roller 25, and a separating guide 26.

The pick-up roller 23 and the feed roller 24 are held rotatably about rotational shafts 231 and 241, respectively, by a sheet feed roller holding member 41 (see FIG. 4) to be described hereinafter and the sheet feed roller holding member 41 is held in the interior of the upper guide unit 21.

The retard roller 25 is held rotatably about a rotational shaft 251 by an unshown retard roller holding member and the retard roller holding member is held in the interior of the lower guide unit 22.

The pick-up roller 23 is provided opposite to the top surface TS of an uppermost sheet P in the sheet feed cassette 141 and rotates in contact with the top surface TS to thus feed the uppermost sheet P out of the sheet feed cassette 141. The feed roller 24 conveys the sheet P fed out by the pick-up roller 23. In the figure, H represents the height showing the top surface level of the uppermost sheet P when the sheet feed cassette 14 has reached its maximum capacity to accommodate sheets P.

The retard roller 25 forms, together with the feed roller 24, a nip N where the sheet P is pinched between the retard roller 25 and the feed roller 24, and conveys the sheet P while separating it from the other sheets P. The separating guide 26 extends diagonally upward toward the nip N and prevents sheets P in a pile from entering the nip N.

The feed roller 24 rotates about the rotational shaft 241 connected to an unshown drive motor (drive source). An unshown drive source transmission gear is disposed between the pick-up roller 23 and the feed roller 24. When the feed roller 24 rotates, the pick-up roller 23 rotates about the rotational shaft 231 in the same direction as in the feed roller 24 via the drive source transmission gear. The retard roller 25 is pressed against the feed roller 24 and driven into rotation about the rotational shaft 251 by the feed roller 24.

Figure 3:
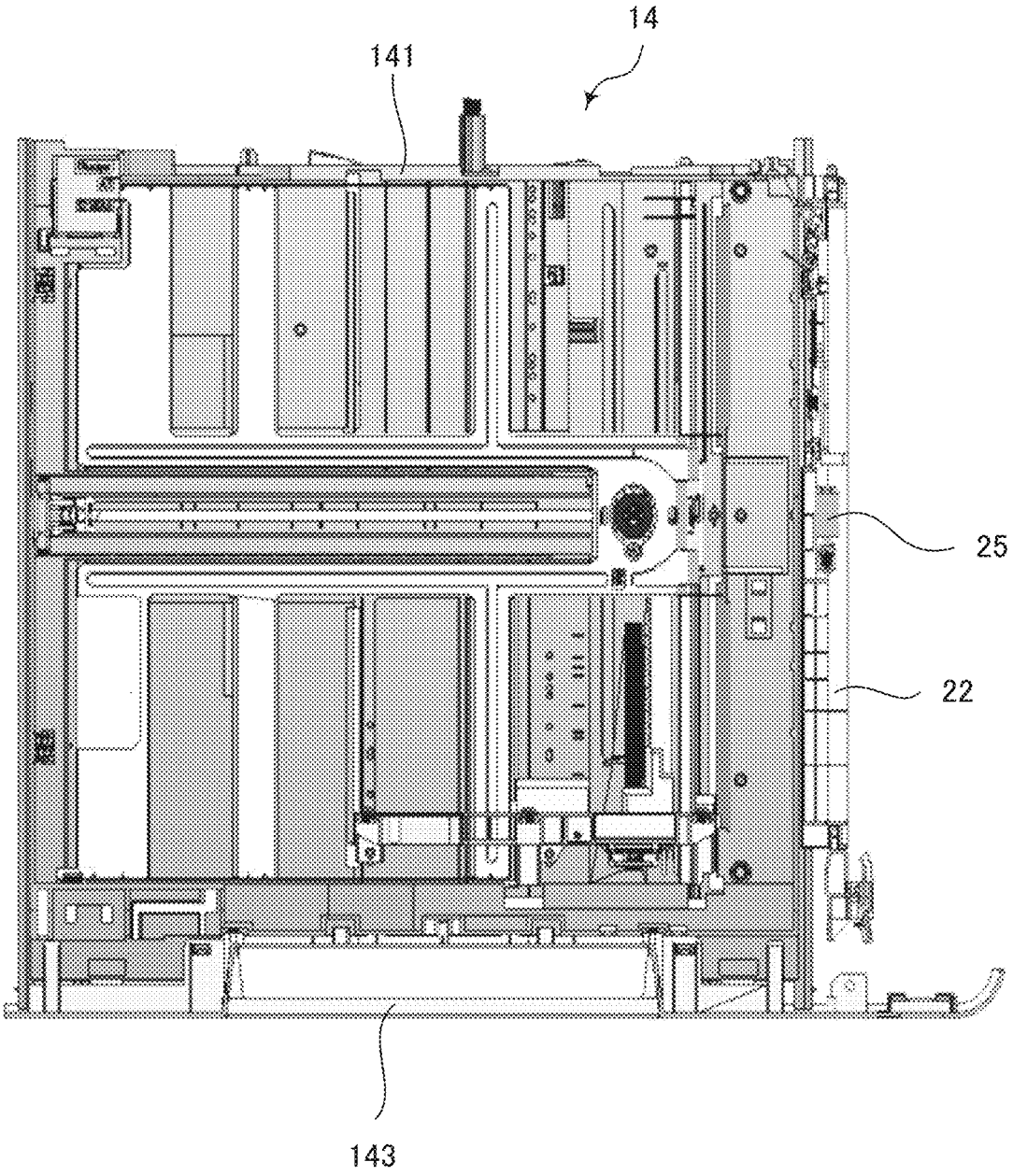
FIG. 3 is a plan view showing the sheet feeder from which an upper guide unit is removed.

FIG. 3 is a plan view showing the sheet feeder 14 from which the upper guide unit 21 is removed. In the middle of the front of the sheet feed cassette 141, a handle 143 is provided which is gripped by the user in loading and unloading the sheet feed cassette 141. The retard roller 25 is disposed in the middle of the sheet feed unit 142 in a widthwise direction thereof orthogonal to the direction of conveyance for the sheet P.

Figure 4:
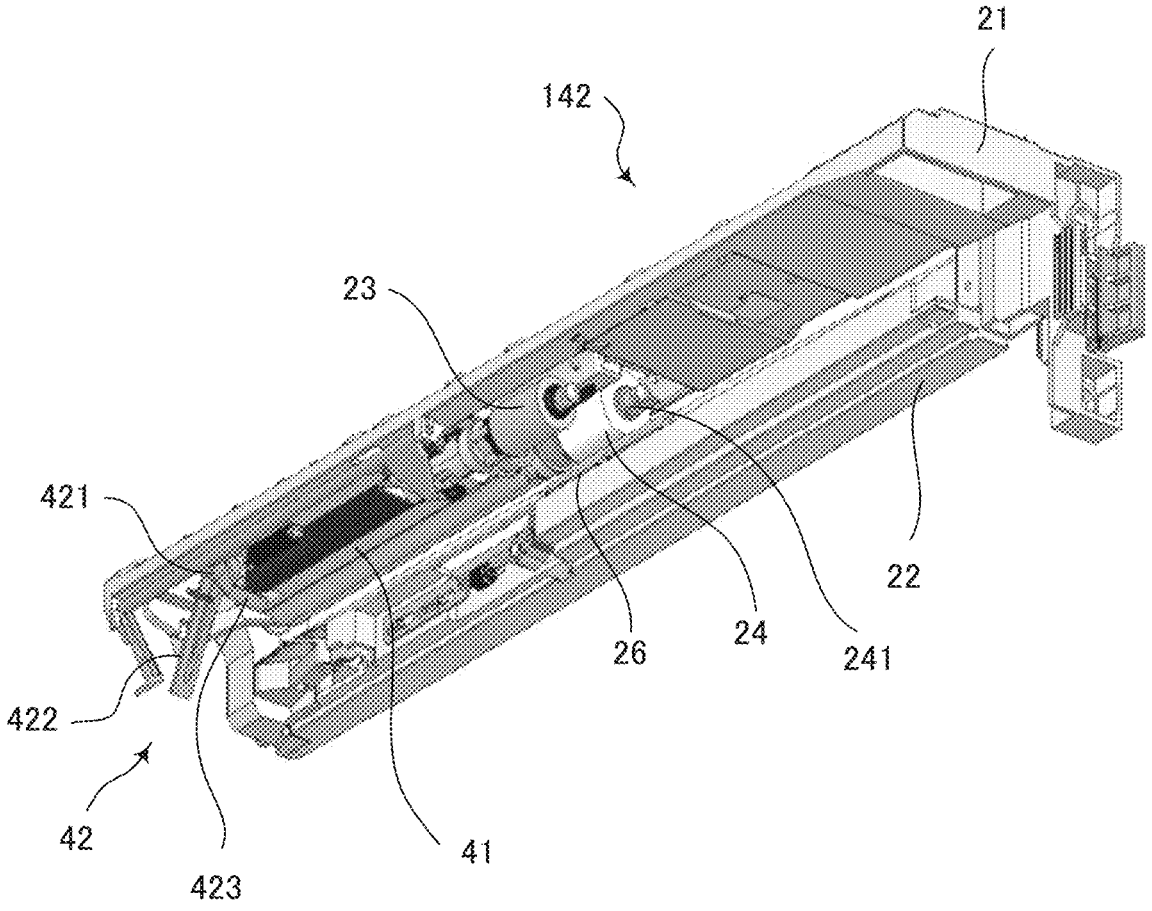
FIG. 4 is a perspective view of a sheet feed unit as viewed from below.

FIG. 4 is a perspective view of the sheet feed unit 142 as viewed from below. The pick-up roller 23 and the feed roller 24 are disposed in the middle of the sheet feed unit 142 in the widthwise direction thereof orthogonal to the direction of conveyance for the sheet P. The separating guide 26 is a rectangular flat member extending diagonally upward and toward directly below the feed roller 24 and prevents sheets P in a pile from entering the nip N (see FIG. 2) as described previously.

The sheet feed roller holding member 41 holding both the pick-up roller 23 and the feed roller 24 is pivotally movable relative to the rotational shaft 241 of the feed roller 24 as a fulcrum and is urged, by an unshown coil spring as an urging member, in a contact direction in which the sheet feed roller holding member 41 moves the pick-up roller 23 toward contact with the top surface TS (see FIG. 2) of the sheet P. The sheet feed roller holding member 41 is an example of the pick-up holding member defined in CLAIMS.

A pick-up pressing member 42 is provided in the device body 140. The pick-up pressing member 42 is formed in the shape of a lever, is pivotally movable on a pivot shaft 421, and presses and urges the sheet feed roller holding member 41 in a direction where the pick-up roller 23 moves away from the top surface TS of the sheet P (upward in this embodiment). An unshown coil spring is mounted as an urging member on the pivot shaft 421.

The pick-up pressing member 42 includes a pressure-actuated portion 422 and a pressing portion 423 both extending below (toward the sheets in the sheet feed cassette 141) with the pivot shaft 421 in between. The pressure-actuated portion 422 receives a pressing force from the sheet feed cassette 141. The abutment portion 423 has a hooked distal end and abuts and presses the distal end against the sheet feed roller holding member 41.

The pressing force of the pick-up pressing member 42 against the sheet feed roller holding member 41 (the force acting in a direction for the sheet feed roller holding member 41 to move the pick-up roller 23 away from the top surface TS of the uppermost sheet P) is greater than the urging force of the coil spring urging the pick-up roller 23 in the contact direction. Therefore, when the pick-up pressing member 42 does not receive the pressing force from the sheet feed cassette 141, the pick-up roller 23 is located away from the top surface TS of the sheet P. In other words, the pick-up pressing member 42 restricts pivotal movement of the sheet feed roller holding member 41 and thus restricts movement of the pick-up roller 23 toward contact with the top surface TS of the uppermost sheet P. The pick-up pressing member 42 is an example of the first restricting member defined in CLAIMS.

Figure 5A:
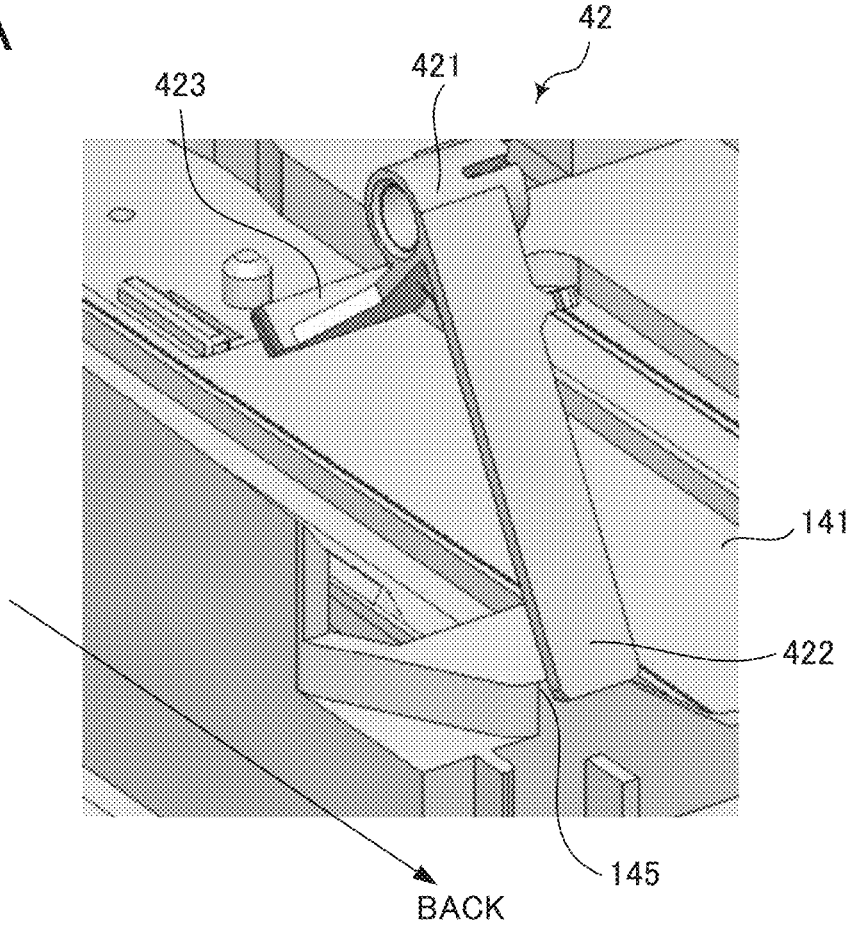
FIG. 5A is a perspective view of a pick-up pressing member and its surrounding portion as viewed from diagonally behind and above.
Figure 5B:
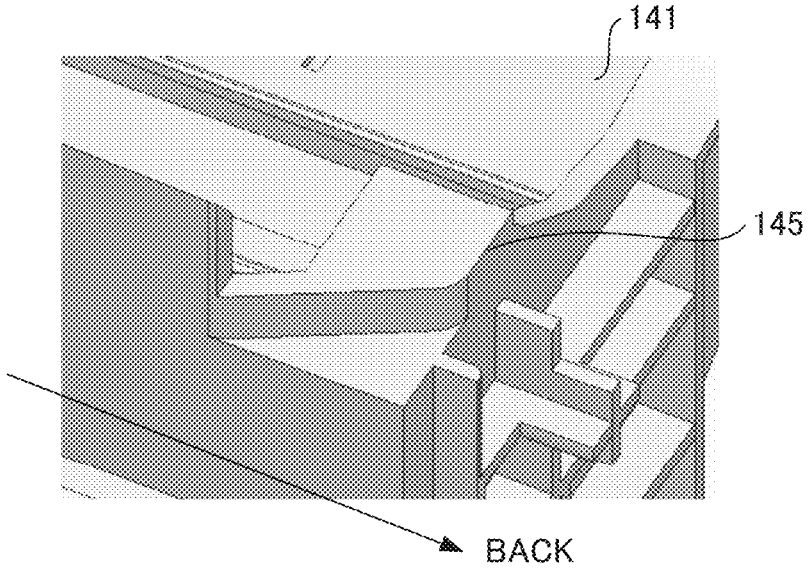
FIG. 5B is a perspective view of a right back portion of the sheet feed cassette as viewed from diagonally behind and above.

FIG. 5A is a perspective view of the pick-up pressing member 42 and its surrounding portion as viewed from diagonally behind and above and FIG. 5B is a perspective view of a right back portion of the sheet feed cassette 141 as viewed from diagonally behind and above. On the right back portion of the sheet feed cassette 141, a pressing cancellation portion 145 is provided which abuts against the pressure-actuated portion 422 of the pick-up pressing member 42 and applies to the pressure-actuated portion 422 a pressing force from the sheet feed cassette 141. The pressing force cancels the pressing of the pick-up pressing member 42 against the sheet feed roller holding member 41. The pressing cancellation portion 145 is an example of the first restriction cancelling portion defined in CLAIMS.

When the sheet feed cassette 141 is loaded into the device body 140, the pressing cancellation portion 145 abuts against the pressure-actuated portion 422 of the pick-up pressing member 42, and the pressure-actuated portion 422 thus receives the pressing force from the sheet feed cassette 141, the pick-up pressing member 42 pivotally moves on the pivot shaft 421, the pressure-actuated portion 422 thus moves upward, and the pressing portion 423 supporting the sheet feed roller holding member 41 moves downward. With these movements of the pressure-actuated portion 422 and the pressing portion 423, the pick-up pressing member 42 pivotally moves in a direction for the pressing portion 423 to move away from the sheet feed roller holding member 41, i.e., a direction to cancel the pressing against the sheet feed roller holding member 41.

When the pick-up pressing member 42 pivotally moves in the above manner, the sheet feed roller holding member 41 and the pick-up roller 23 are ready to move toward the top surface TS of the sheet P and the pick-up roller 23 becomes movable to the predetermined position to be finally reached (the top surface level H shown in FIG. 2).

Figure 6:
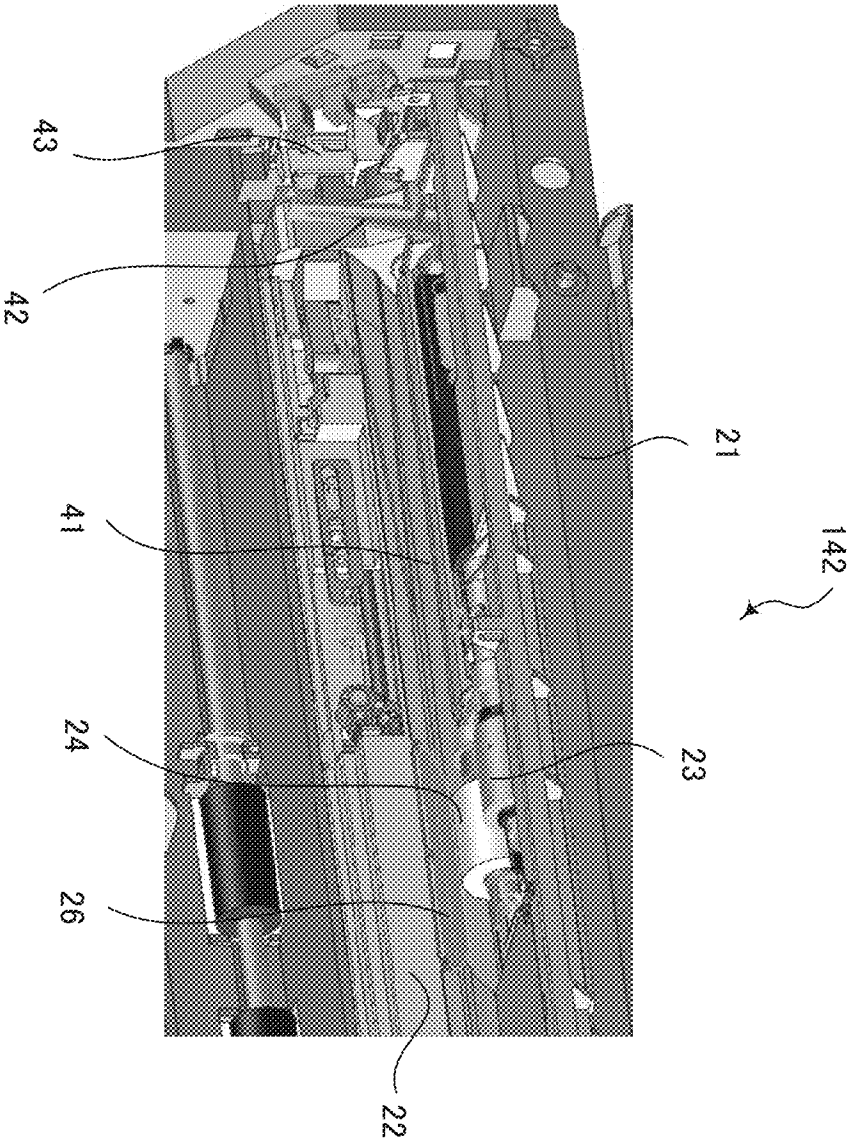
FIG. 6 is a perspective view of a back portion of the sheet feed unit as viewed from below.

FIG. 6 is a perspective view of a back portion of the sheet feed unit 142 (a portion thereof close to the back of the image forming apparatus 1) as viewed from below. A restricting member 43 provided rearward of the pick-up pressing member 42 restricts pivotal movement of the sheet feed roller holding member 41 and thus restricts movement of the pick-up roller 23 toward contact with the top surface TS of the sheet P.

Figure 7:
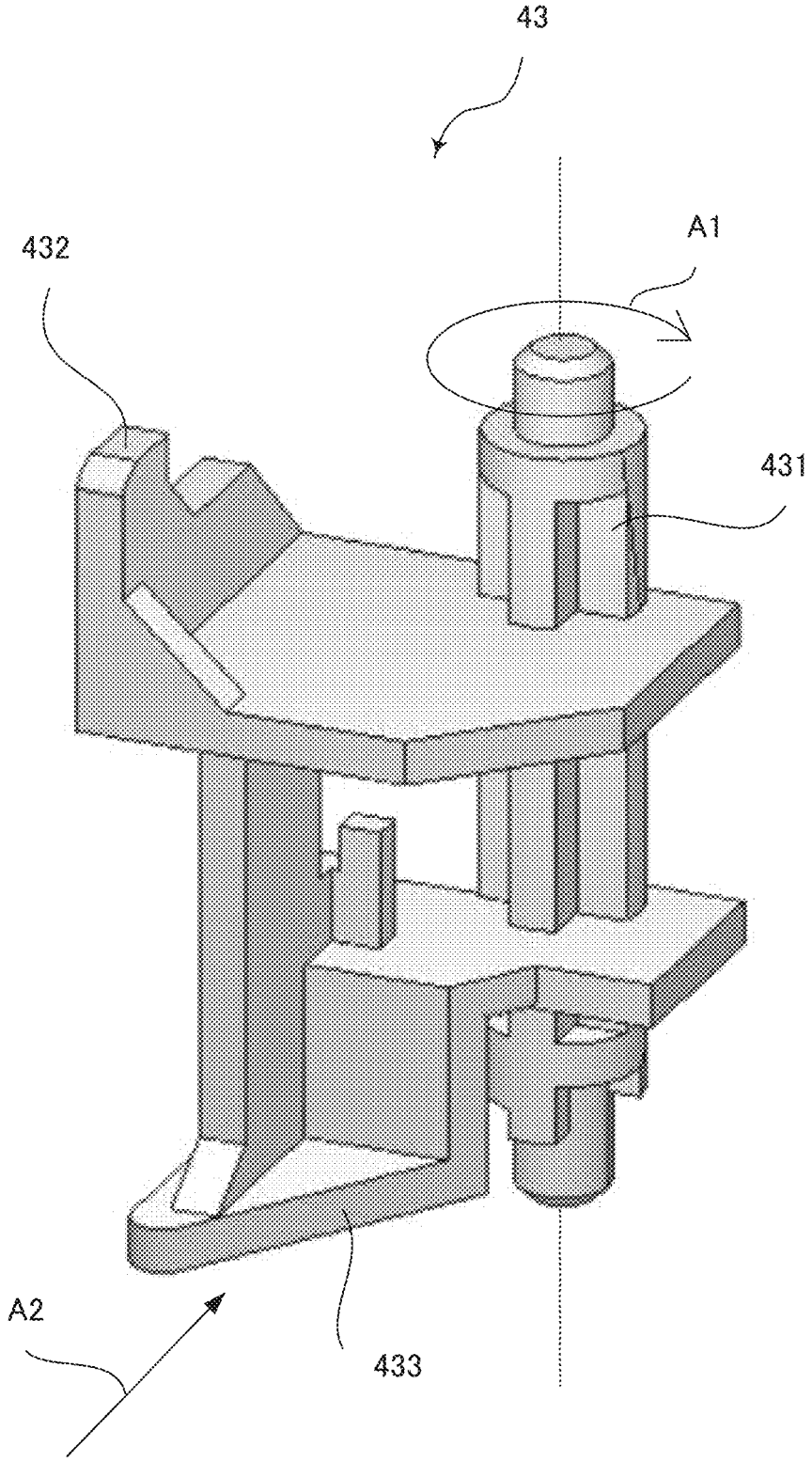
FIG. 7 is a perspective view showing a restricting member.
Figure 8A:
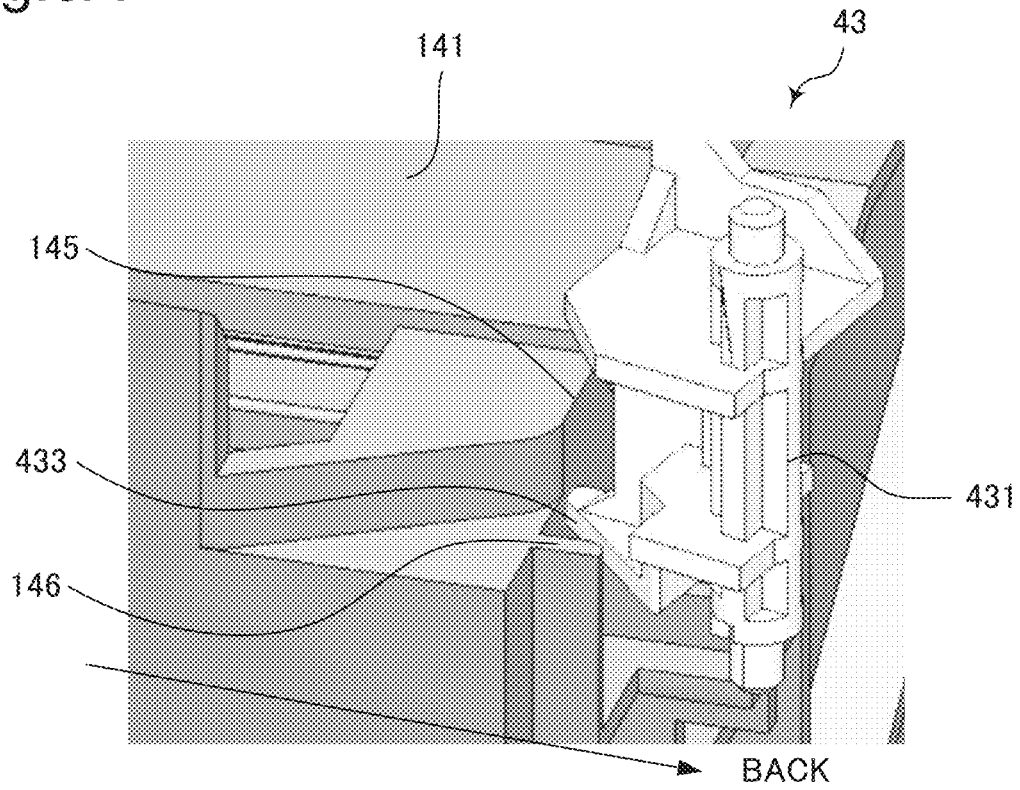
FIG. 8A is a perspective view of the restricting member and its surrounding portion as viewed from diagonally behind and above.
Figure 8B:
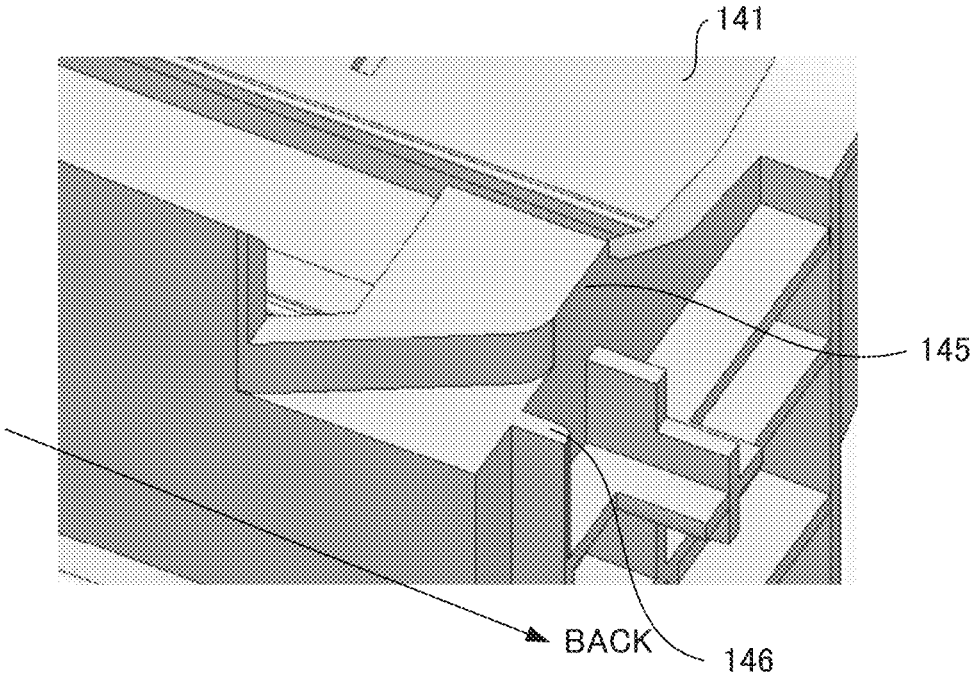
FIG. 8B is a perspective view of a back portion of the sheet feed cassette close to the sheet feed unit as viewed from diagonally behind and above.

FIG. 7 is a perspective view showing the restricting member 43. FIG. 8A is a perspective view of the restricting member 43 and its surrounding portion as viewed from diagonally behind and above and FIG. 8B is a perspective view of a back portion of the sheet feed cassette 141 close to the sheet feed unit 142 as viewed from diagonally behind and above. The restricting member 43 is an example of the second restricting member defined in CLAIMS.

A restriction cancelling portion 146 (in the shape of a rib) is provided on the back side of the sheet feed cassette 141 and close to the sheet feed unit 142. The restriction cancelling portion 146 abuts against the restricting member 43 and applies to the restricting member 43 a pressing force from the sheet feed cassette 141. The restriction cancelling portion 146 is an example of the second restriction cancelling portion defined in CLAIMS.

The restricting member 43 is pivotally movable on a pivot shaft 431 extending in the vertical direction and includes: a support portion 432 supporting the sheet feed roller holding member 41 from below; and an abutment portion 433 (an inclined surface) receiving a pressing force from the sheet feed cassette 141. Furthermore, an unshown coil spring as an urging member is wound around the pivot shaft 431 to urge the restricting member 43 toward pivotal movement in a direction opposite to the direction of the arrow A1 in FIG. 7.

The abutment portion 433 receives the pressing force in the direction of the arrow A2 (see FIG. 7) from the sheet feed cassette 141. When the abutment portion 433 receives the pressing force in the direction of the arrow A2 from the sheet feed cassette 141, the restricting member 43 pivotally moves, against the urging force of the urging member, in the direction of the arrow A1 on the pivot shaft 431.

Figure 9:
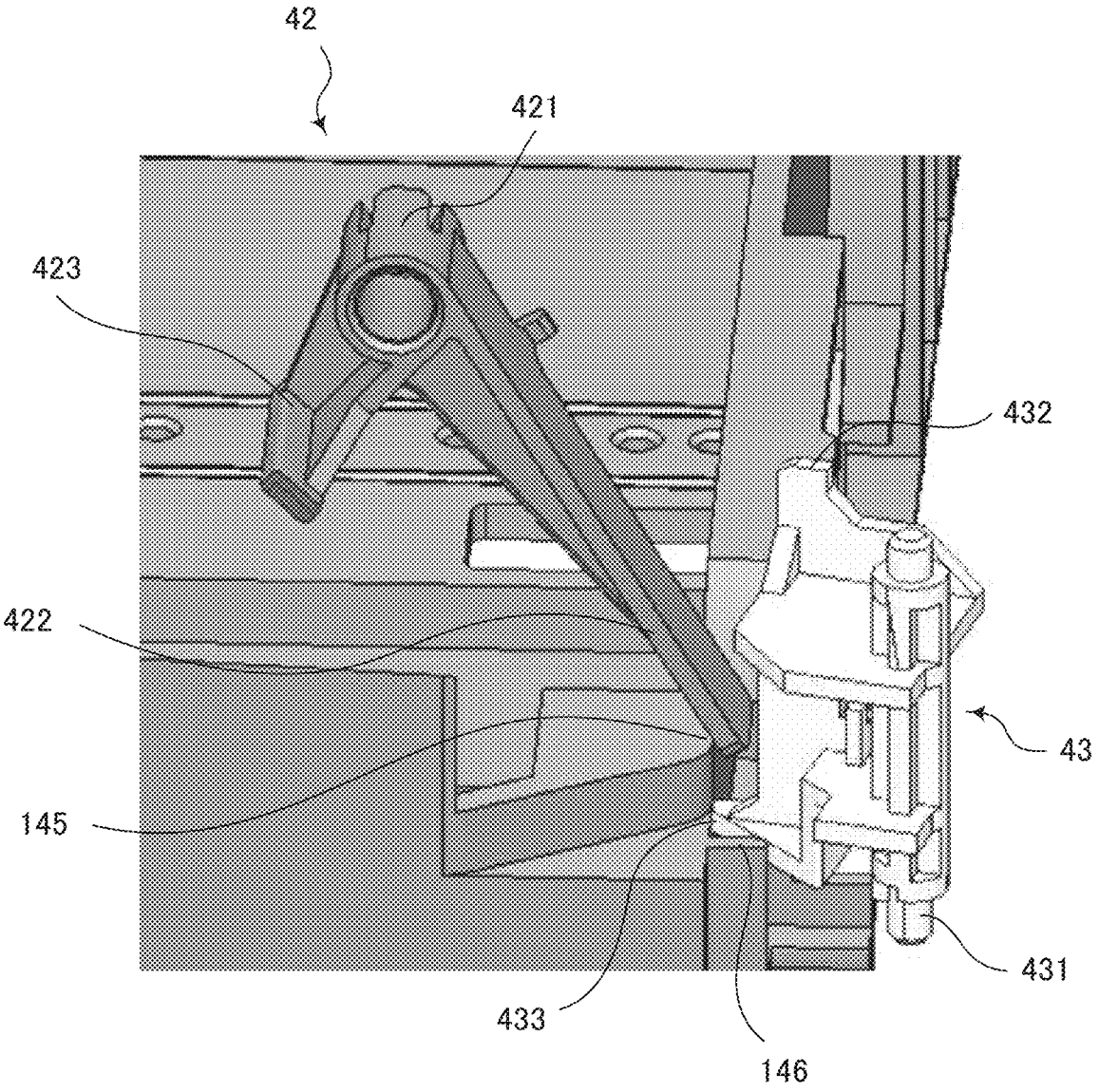
FIG. 9 is a perspective view of the restricting member and the pick-up pressing member as viewed from behind and above.

FIG. 9 is a perspective view of the restricting member 43 and the pick-up pressing member 42 as viewed from above. The restricting member 43 is disposed as deep as possible in the back of the device body 140 (as close as possible to the back of the image forming apparatus 1) and rearward of the pick-up pressing member 42.

Figure 10A:
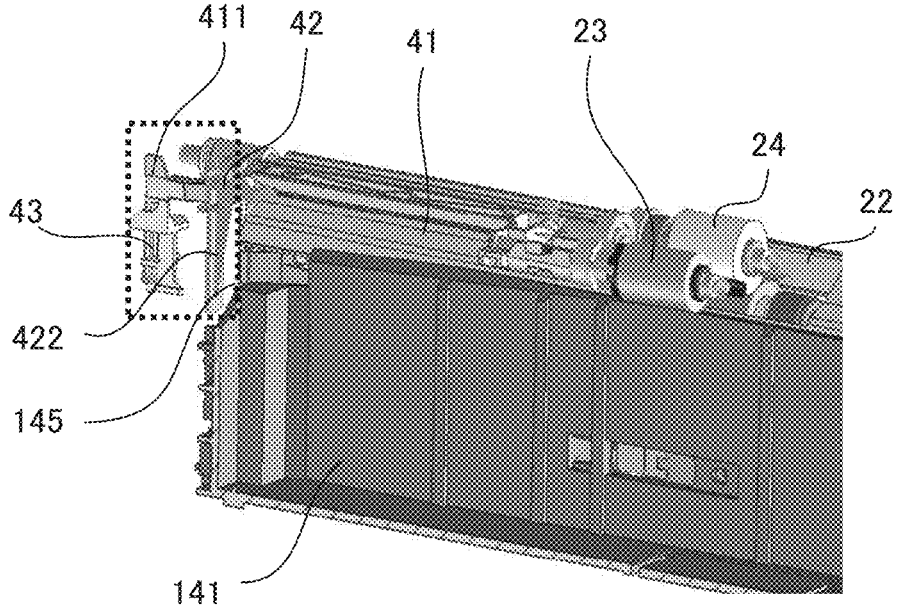
FIG. 10A is a perspective view of the restricting member and its surrounding portion during restriction on pivotal movement of a sheet feed roller holding member as viewed from left ahead and above.
Figure 10B:
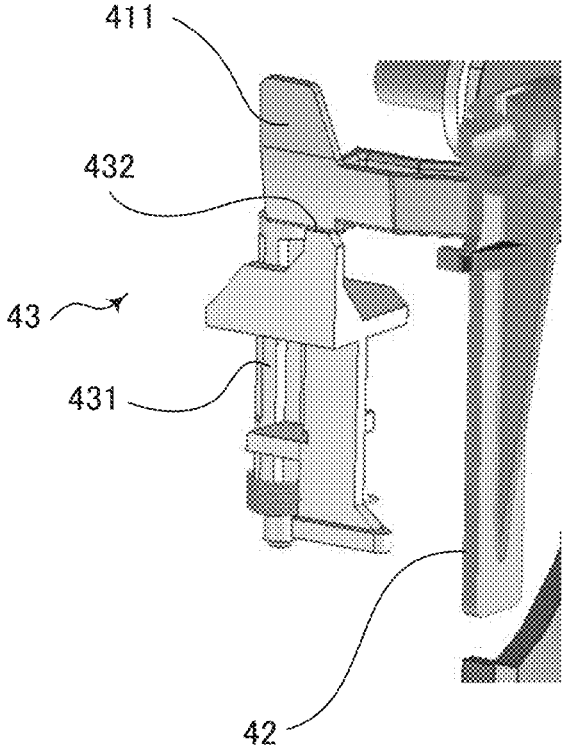
FIG. 10B is an enlarged view of a portion surrounded by the broken lines in FIG.

FIG. 10A is a perspective view of the restricting member 43 and its surrounding portion during restriction on pivotal movement of the sheet feed roller holding member 41 as viewed from above. FIG. 10B is an enlarged view of a portion surrounded by the broken lines in FIG. 10A.

Figure 11A:
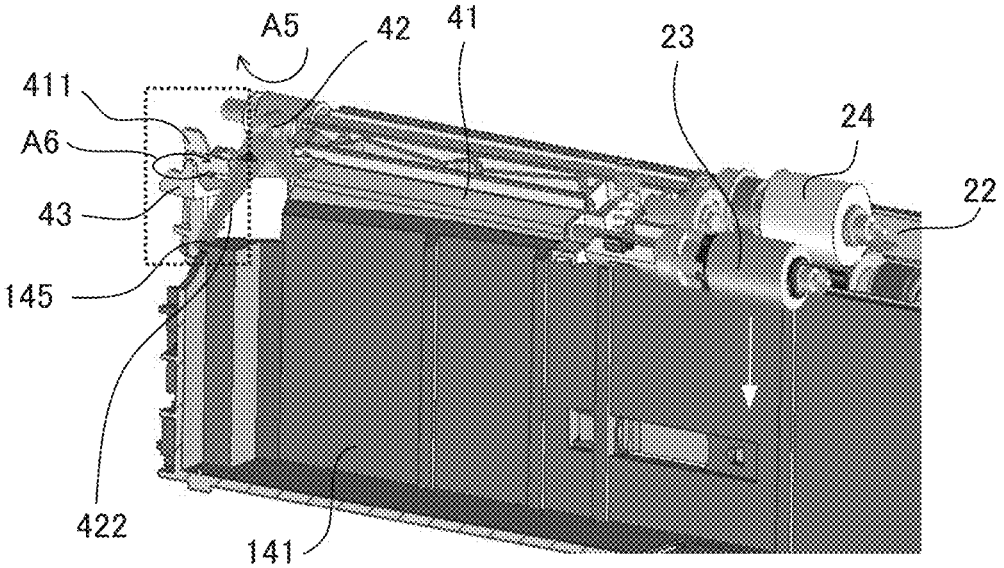
FIG. 11A is a perspective view of the restricting member and its surrounding portion without restriction on pivotal movement of the sheet feed roller holding member as viewed from left ahead and above.
Figure 11B:
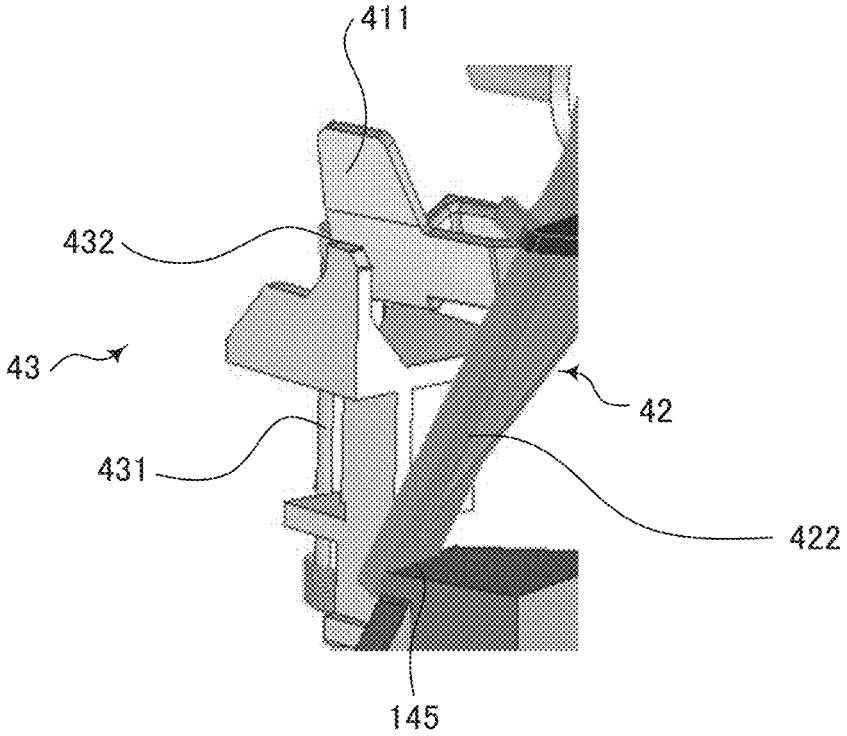
FIG. 11B is an enlarged view of a portion surrounded by the broken lines in FIG. 11A.

FIG. 11A is a perspective view of the restricting member 43 and its surrounding portion without restriction on pivotal movement of the sheet feed roller holding member 41 as viewed from above. FIG. 11B is an enlarged view of a portion surrounded by the broken lines in FIG. 11A.

A to-be-supported portion 411 of the sheet feed roller holding member 41 provided on the back side thereof (the side thereof close to the back of the image forming apparatus 1) rests on an upper end of the support portion 432 of the restricting member 43, whereby the pivotal movement of the sheet feed roller holding member 41 is restricted. Thus, the restricting member 43 restricts downward movement of the sheet feed roller holding member 41 (and the pick-up roller 23).

In the state shown in FIGS. 10A and 10B, the restricting member 43 is not subjected to the pressing force from the sheet feed cassette 141 and does not pivotally move. Therefore, the bottom surface of the to-be-supported portion 411 remains resting on the support portion 432, whereby the pivotal movement of the sheet feed roller holding member 41 is restricted. Furthermore, the pick-up pressing member 42 is also not subjected to the pressing force from the sheet feed cassette 14 and does not pivotally move, whereby the pressure-actuated portion 422 takes a downwardly extending position.

When the sheet feed cassette 141 is becoming loaded into the device body 140 and the pressure-actuated portion 422 of the pick-up pressing member 42 receives the pressing force from the pressing cancellation portion 145 of the sheet feed cassette 141, the pick-up pressing member 42 pivotally moves in the direction of the arrow A5 as shown in FIGS. 11A and 11B. Subsequently, when the abutment portion 433 of the restricting member 43 also receives the pressing force from the restriction cancelling portion 146 of the sheet feed cassette 141, the restricting member 43 pivotally moves in the direction of the arrow A6 on the pivot shaft 431. Therefore, the to-be-supported portion 411 falls out of support by the support portion 432 and slides down from the support portion 432. At this time, the sheet feed roller holding member 41 is released from the restriction of the restricting member 43, the sheet feed roller holding member 41 and the pick-up roller 23 move downward by their own weights and the urging force (move in the direction of the arrow shown in FIG. 11A), and the pick-up roller 23 moves toward contact with the top surface TS of the sheet P.

Figure 12A:
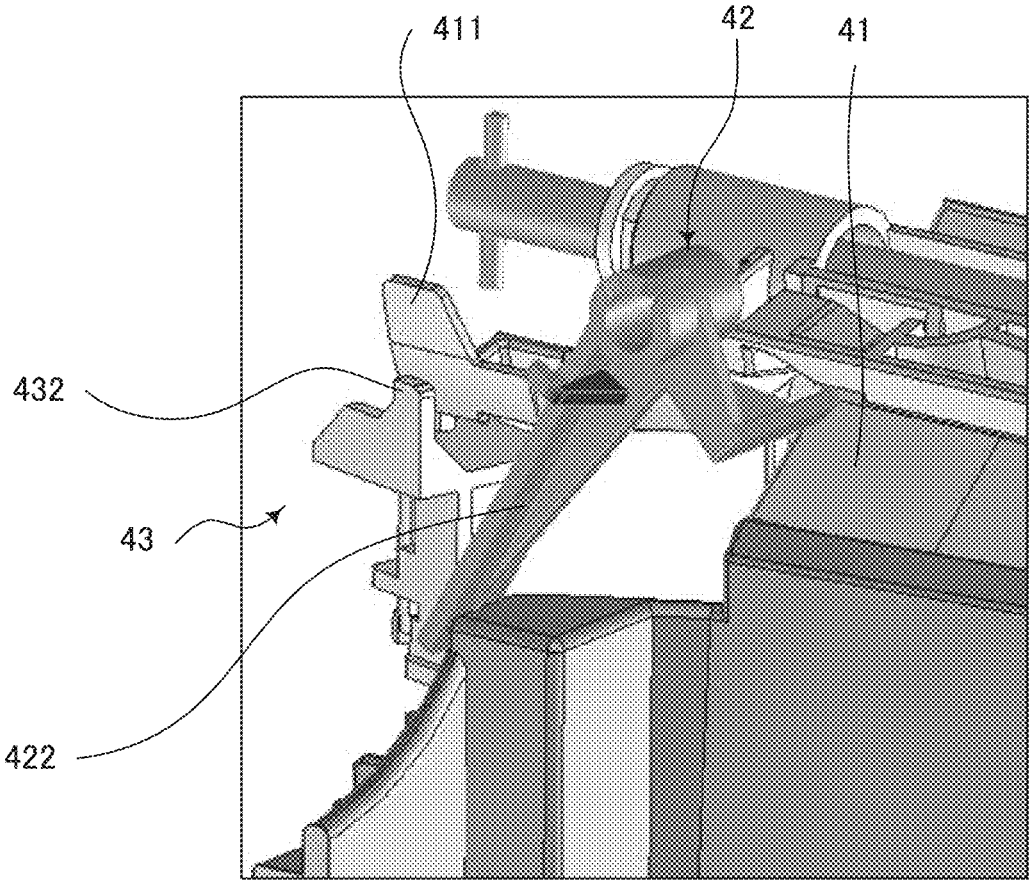
FIG. 12A is a view showing states of the pick-up pressing member and the restricting member when the sheet feed cassette is loaded.
Figure 12B:
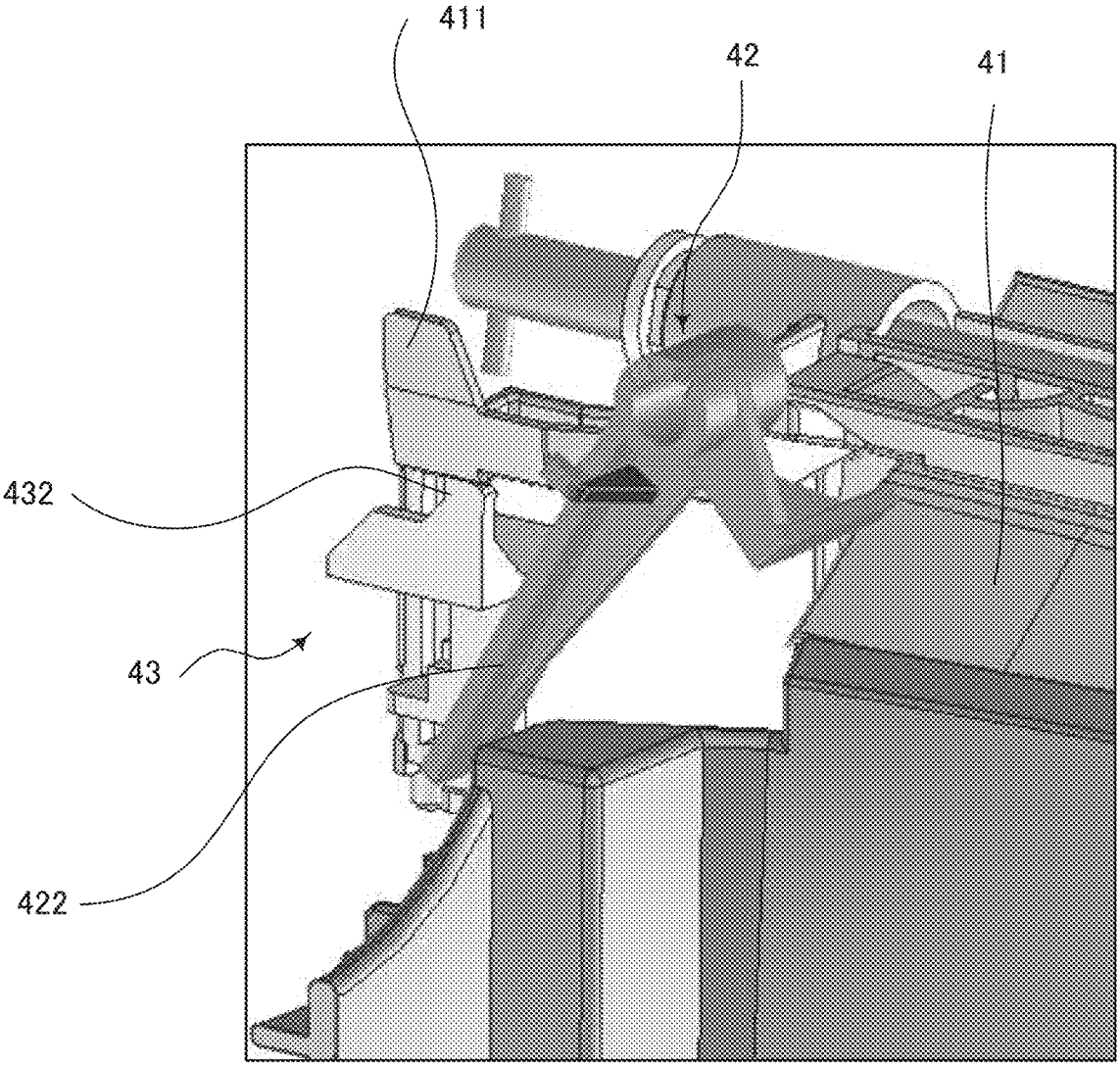
FIG. 12B is a view showing states of the pick-up pressing member and the restricting member when the sheet feed cassette starts to be withdrawn from its loaded state.
Figure 12C:
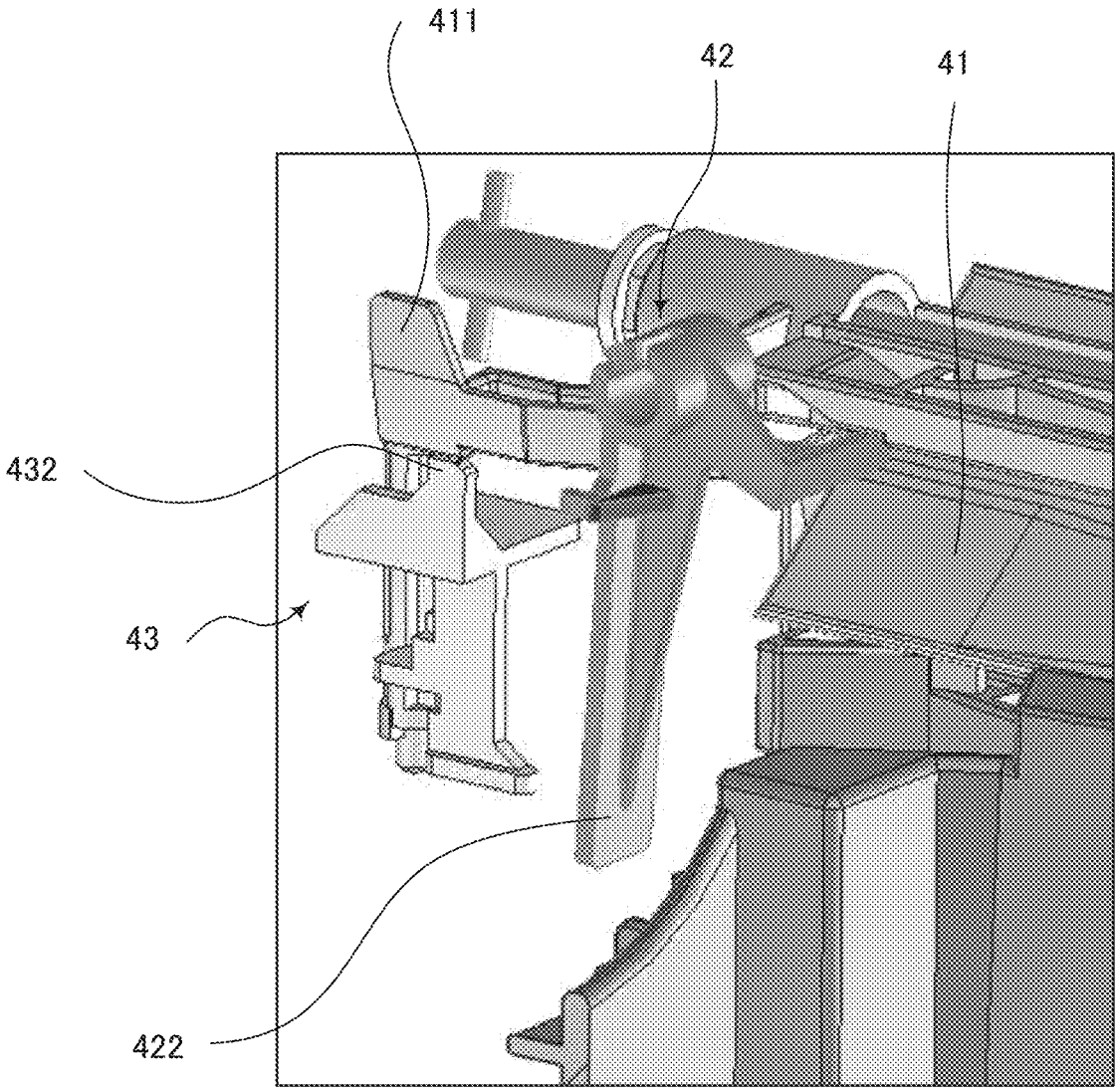
FIG. 12C is a view showing states of the pick-up pressing member and the restricting member when the sheet feed cassette has been withdrawn from the device body.

FIG. 12A is a view showing states of the pick-up pressing member 42 and the restricting member 43 when the sheet feed cassette 141 is loaded. FIG. 12B is a view showing states of the pick-up pressing member 42 and the restricting member 43 when the sheet feed cassette 141 starts to be withdrawn from its loaded state. FIG. 12C is a view showing states of the pick-up pressing member 42 and the restricting member 43 when the sheet feed cassette 141 has been withdrawn from the device body 140.

As described above, while the sheet feed cassette 141 is loaded in the device body 140, the pressure-actuated portion 422 of the pick-up pressing member 42 is in a state where it receives a pressing force from the pressing cancellation portion 145 of the sheet feed cassette 141, and the abutment portion 433 of the restricting member 43 is in a state where it receives a pressing force from the restriction cancelling portion 146 of the sheet feed cassette 141 (see FIG. 12A). On the other hand, when the sheet feed cassette 141 is being withdrawn from the loaded position in the device body 140 and is being unloaded, the abutment portion 433 of the restricting member 43 is first released from the pressing force of the restriction cancelling portion 146 of the sheet feed cassette 141 and the restricting member 43 thus pivotally moves in the direction opposite to the direction of the arrow A6 in FIG. 11A. Since, at this time, the sheet feed roller holding member 41 and the pick-up roller 23 stay down by their own weights and the urging force, the support portion 432 of the restricting member 43 interferes with and engages on an end portion of the to-be-supported portion 411 and the support portion 432 has not yet supported the to-be-supported portion 411 thereon.

Subsequently, in consequence of the release of the abutment portion 433 of the restricting member 43 from the pressing force of the restriction cancelling portion 146, the pressure-actuated portion 422 of the pick-up pressing member 42 is put into a state where it is released from the pressing force of the pressing cancellation portion 145 of the sheet feed cassette 141. Thus, the sheet feed roller holding member 41 is subjected to the restriction of the restricting member 43, whereby the sheet feed roller holding member 41 and the pick-up roller 23 are pushed up by the restricting member 43 and move toward their positions before the downward movement. When, by this movement, the sheet feed roller holding member 41 and the pick-up roller 23 move to positions where the to-be-supported portion 411 is disengaged from the support portion 432, the support portion 432 moves under the to-be-supported portion 411 (see FIG. 12B). Thus, the support portion 432 comes under the to-be-supported portion 411 and becomes able to support the to-be-supported portion 411. Then, when the sheet feed cassette 141 is fully withdrawn, the sheet feed cassette holding member 41 and the pick-up roller 23 are further pushed up by the restricting member 43 and return to their positions before the downward movement (see FIG. 12C).

In the above embodiment as described in relation to the loading of the sheet feed cassette 141, as for (i) both the timing for the pressing cancellation portion 145 of the sheet feed cassette 141 to press the pressure-actuated portion 422 of the pick-up pressing member 42 and the timing for the restriction cancelling portion 146 of the sheet feed cassette 141 to press the abutment portion 433 of the restricting member 43, the pressing of the pressing cancellation portion 145 against the pressure-actuated portion 422 is earlier. However, the pressing of the pressing cancellation portion 145 against the pressure-actuated portion 422 may be performed concurrently with the pressing of the restriction cancelling portion 146 against the abutment portion 433.

In the above embodiment as described in relation to the unloading of the sheet feed cassette 141, as for (ii) both the timing to cancel the pressing of the pressing cancellation portion 145 of the sheet feed cassette 141 against the pressure-actuated portion 422 of the pick-up pressing member 42 and the timing to cancel the pressing of the restriction cancelling portion 146 of the sheet feed cassette 141 against the abutment portion 433 of the restricting member 43, the cancellation of the pressing of the restriction cancelling portion 146 against the abutment portion 433 is earlier. However, the cancellation of the pressing of the pressing cancellation portion 145 against the pressure-actuated portion 422 may be performed concurrently with the cancellation of the pressing of the restriction cancelling portion 146 against the abutment portion 433.

As thus far described, in the above embodiment, when the sheet feed cassette 141 is not present in the device body 140, the movement of the sheet feed roller holding member 41 and the pick-up roller 23 toward the top surface TS of the sheet P is restricted by the restricting member 43. This restriction is not cancelled until the sheet feed cassette 141 is loaded into the device body 140 and a pressing force from the sheet feed cassette 141 is thus applied to the restricting member 43. The restricting member 43 abuts on the end of the sheet feed cassette 141 located on the back side of the device body 140 in a state where the sheet feed cassette 141 is loaded in the device body 140, that is, the restricting member 43 is located in the back of the device body 140 (close to the back of the image forming apparatus 1). Therefore, the restricting member 43 is not subjected to the pressing force from the sheet feed cassette 141 until the loading of the sheet feed cassette 141 is completed or nearly completed. Thus, the pick-up roller 23 does not move until the loading of the sheet feed cassette 141 is completed or nearly completed.

As just described, in the course of loading of the sheet feed cassette 141, the pick-up roller 23 does not move. Therefore, even if a stack of sheets P are accommodated in the sheet feed cassette 141, unless the uppermost sheet P in the stack is in contact with the pick-up roller 23 located at a position where it is subjected to the above restriction, the pick-up roller 23 does not reach the top surface TS of the uppermost sheet P in the course of loading of the sheet feed cassette 141. For this reason, it can be avoided that, in the course of loading of the sheet feed cassette 141, the pick-up roller 23 makes contact with the top surface TS of the sheet P to damage the sheet. Therefore, without having to additionally provide a solenoid or a sensor, it is possible to increase, with a relatively simple structure, the maximum capacity to accommodate sheets in the sheet feed cassette 141.

Recently, in order to increase the productivity of a sheet feeder, for example, there is a tendency to increase its maximum capacity to accommodate sheets. If, in this case, the height of the sheet feeder is increased, its maximum capacity to accommodate sheets can be increased. However, when the space for disposing the sheet feeder is constrained, it is not easy to increase the height.

Furthermore, if, for example, 550 sheets are accommodated in a sheet feed cassette having a maximum capacity of 500 sheets without changing the height of the sheet feeder, the pick-up roller in the course of loading of the sheet feed cassette into the sheet feeder body will make contact with the top surface of the uppermost sheet to damage the sheet.

In order to avoid such contact of the pick-up roller with the top surface of the sheet, for example, there is a technique for using a solenoid or a sensor to restrict downward movement of the pick-up roller. However, this invites problems of an increased number of parts and an increased complexity of the device and increases the cost.

Unlike the above conventional technique, in the above embodiment, the maximum capacity to accommodate sheets in the sheet feed cassette can be increased with a relatively simple structure as described above.

The present disclosure is not limited to the structure of the above embodiment and can be modified in various ways. The structure and processing of the above embodiment described with reference to FIGS. 1 to 12C are merely illustrative of the present disclosure and are not intended to limit the present disclosure to them.

While the present disclosure has been described in detail with reference to the embodiments thereof, it would be apparent to those skilled in the art the various changes and modifications may be made therein within the scope defined by the appended claims.

What is claimed is:

1. A sheet feeder comprising:

a sheet feed cassette capable of being loaded into and unloaded from a device body of the sheet feeder, capable of being withdrawn from a back toward a front of the device body, and capable of accommodating a plurality of sheets;

a pick-up roller provided in the device body and capable of moving toward a top surface of the uppermost of the plurality of sheets accommodated in the sheet feed cassette and rotating in contact with the top surface of the uppermost sheet to thus feed the uppermost sheet out of the sheet feed cassette;

a pick-up holding member in the form of pivotable long plate that is provided in the device body, holds the pick-up roller capable of coming into contact with and away from the top surface of the uppermost sheet, supports the pick-up roller rotatably, supports the pick-up roller while urging the pick-up roller toward contact with the top surface of the uppermost sheet, and, in operative association with operation of loading of the sheet feed cassette into the device body, makes pivotal movement to move the pick-up roller toward contact with the top surface of the uppermost sheet and move the pick-up roller to a predetermined position to be finally reached;

a first restricting member is formed in the shape of a lever that is provided in the device body and restricts the pivotal movement of the pick-up holding member, resulting in restriction on movement of the pick-up roller toward contact with the top surface of the uppermost sheet;

a second restriction stopper that is disposed rearward of the first restricting member in the device body and restricts the pivotal movement of the pick-up holding member, resulting in restriction on movement of the pick-up roller toward contact with the top surface of the uppermost sheet;

a first restriction cancelling abutment that is provided in the sheet feed cassette and abuts against the first restricting member in the device body to apply a pressing force from the sheet feed cassette to the first restricting member, thus cancelling the restriction of the first restricting member; and a second restriction cancelling abutment in the shape of a rib that is provided in the sheet feed cassette and, in association with cancellation of the restriction of the first restricting member by the first restriction cancelling abutment in the device body, abuts against the second restriction stopper to apply a pressing force from the sheet feed cassette to the second restriction stopper, thus cancelling the restriction of the second restriction stopper upon completion of loading of the sheet feed cassette, wherein the pick-up holding member moves the predetermined position after restriction cancellation by the second restriction cancelling abutment.

2. The sheet feeder according to claim 1, wherein the second restriction stopper abuts on an end of the sheet feed cassette located on a back side of the device body in a state where the sheet feed cassette is loaded in the device body.

3. The sheet feeder according to claim 1, a sheet feed cassette capable of being loaded into and unloaded from a device body of the sheet feeder, capable of being withdrawn from a back toward a front of the device body, and capable of accommodating a plurality of sheets;

a pick-up roller provided in the device body and capable of moving toward a top surface of the uppermost of the plurality of sheets accommodated in the sheet feed cassette and rotating in contact with the top surface of the uppermost sheet to thus feed the uppermost sheet out of the sheet feed cassette;

a pick-up holding member in the form of pivotable long plate that is provided in the device body, holds the pick-up roller capable of coming into contact with and away from the top surface of the uppermost sheet, supports the pick-up roller rotatably, supports the pick-up roller while urging the pick-up roller toward contact with the top surface of the uppermost sheet, and, in operative association with operation of loading of the sheet feed cassette into the device body, makes pivotal movement to move the pick-up roller toward contact with the top surface of the uppermost sheet and move the pick-up roller to a predetermined position to be finally reached;

a first restricting member is formed in the shape of a lever that is provided in the device body and restricts the pivotal movement of the pick-up holding member, resulting in restriction on movement of the pick-up roller toward contact with the top surface of the uppermost sheet;

a second restriction stopper that is disposed rearward of the first restricting member in the device body and restricts the pivotal movement of the pick-up holding member, resulting in restriction on movement of the pick-up roller toward contact with the top surface of the uppermost sheet;

a first restriction cancelling abutment that is provided in the sheet feed cassette and abuts against the first restricting member in the device body to apply a pressing force from the sheet feed cassette to the first restricting member, thus cancelling the restriction of the first restricting member; and a second restriction cancelling abutment in the shape of a rib that is provided in the sheet feed cassette and, in association with cancellation of the restriction of the first restricting member by the first restriction cancelling abutment in the device body, abuts against the second restriction stopper to apply a pressing force from the sheet feed cassette to the second restriction stopper, thus cancelling the restriction of the second restriction stopper upon completion of loading of the sheet feed cassette, wherein the second restriction stopper is pivotally movable on a pivot shaft extending in a vertical direction and comprises: an abutment portion receiving a pressing force from the sheet feed cassette; and a support portion supporting the pick-up holding member from below, when pivotally moving on the pivot shaft, the restriction stopper switches between a state for supporting the pick-up holding member from below to make restriction on pivotal movement of the pick-up holding member and a state for not supporting the pick-up holding member from below, and when the abutment portion abuts against the second restriction cancelling abutment to receive the pressing force from the sheet feed cassette, the restriction stopper pivotally moves on the pivot shaft and switches from the state for supporting the pick-up holding member from below to the state for not supporting the pick-up holding member from below.

4. The sheet feeder according to claim 3, wherein, during loading of the sheet feed cassette into the device body, cancellation of the restriction of the first restricting member caused by the sheet feed cassette applying the pressing force to the first restricting member is performed earlier than cancellation of the restriction of the second restriction stopper caused by the sheet feed cassette applying the pressing force to the second restriction stopper.

* * * * *